US005813754A

United States Patent [19]

Williams

[11] Patent Number: 5,813,754

[45] Date of Patent: Sep. 29, 1998

[54] VIBRATION INPUT TO MOVING AQUEOUS CEMETITIOUS SLURRY

[75] Inventor: Richard A. Williams, Dana Point, Calif.

[73] Assignee: Matrix Master, Inc., Costa Mesa, Calif.

[21] Appl. No.: 615,597

[22] Filed: Mar. 13, 1996

[51] Int. Cl.[6] ..... B28C 5/16; B01F 11/00

[52] U.S. Cl. ..... 366/6; 366/65; 366/114; 366/314

[58] Field of Search ..... 366/2, 6, 14, 15, 366/31, 32, 108, 114, 115, 116, 141, 65, 314

[56] References Cited

U.S. PATENT DOCUMENTS

| | | | |
|---|---|---|---|
| 3,006,615 | 10/1961 | Mason, Jr. . | |
| 3,295,838 | 1/1967 | Ban | 366/114 |
| 3,601,369 | 8/1971 | Wahl | 366/114 |
| 4,106,111 | 8/1978 | Rose | 366/114 X |
| 4,302,112 | 11/1981 | Steenstrup | 366/114 |
| 4,588,299 | 5/1986 | Brown et al. . | |
| 4,830,505 | 5/1989 | Dunton et al. . | |
| 4,904,089 | 2/1990 | Dunton et al. . | |
| 5,395,593 | 3/1995 | Martin | 366/114 |

FOREIGN PATENT DOCUMENTS

| | | | |
|---|---|---|---|
| 2399273 | 4/1979 | France | 366/114 |
| 181622 | 4/1966 | U.S.S.R. | 366/114 |
| 197514 | 8/1967 | U.S.S.R. | 366/114 |
| 289932 | 2/1971 | U.S.S.R. | 366/114 |
| 1339028 | 9/1987 | U.S.S.R. | 366/31 |
| 1606173 | 11/1990 | U.S.S.R. | 366/114 |
| 2091117 | 7/1982 | United Kingdom | 366/114 |

OTHER PUBLICATIONS

VIBCO Vibration Products brochure.

*Primary Examiner*—Charles E. Cooley
*Attorney, Agent, or Firm*—William W. Haefliger

[57] ABSTRACT

A container is provided for slurry; an impeller is provided to effect slurry movement in the container; and a vibrator is operated for transmitting sufficient vibration to the moving slurry to lower the water/cement ratio to a low level, and at a water temperature within a specified range. The location of vibration transmission from the vibrator can be adjusted along the wall of the container.

40 Claims, 4 Drawing Sheets

VIBRATION INPUT TO MOVING AQUEOUS CEMETITIOUS SLURRY

BACKGROUND OF THE INVENTION

This invention relates generally to the enhancement of fluidity of aqueous cementitious slurries; and more particularly concerns transmission of vibration into such slurries which are moving, as in mixing vessels, thereby to achieve lower water cement ratios.

A typical concrete batch contains proportionly 500 pounds of cement, 267 pounds of water, 1,350 pounds of dry sand, and 1,850 pounds of coarse aggregate. Since the sand is normally added in wet condition, the batch weight (as measured) of added materials is typically 500 pounds of cement, 200 pounds of water, 1,417 pounds of wet sand (5% water), and 1,850 pounds of aggregate. This works out to a water/cement ratio of 0.40 in the water/cement slurry mixing vessel. If fluidity or flowability of the mix could be enhanced, more cement could be added to mix with water, and less dry cement would be required to be added to the ready-mix truck mixing vessel, reducing dust creation. A desired water/cement ratio is about 0.30, corresponding to 677 pounds of cement added to the slurry mixer. Accordingly, there is need for method and means to achieve enhanced fluidity of the slurry in the slurry mixing vessel.

SUMMARY OF THE INVENTION

It is a major object of the invention to provide method and apparatus meeting the above need.

Accordingly, it is one object of the invention to provide a fluidity enhancing method that includes a) providing a container for the slurry and effecting movement of the slurry, in the container, and b) transmitting vibration to the moving slurry.

Such vibration transmission to achieve enhanced slurry flowability is not obvious, since non-moving water and cement in a vessel do not mix well or stay in suspension in the presence of low or high frequency vibrations, the cement tending to settle downward, as the water tends to rise, creating separation.

It is another object to transmit vibration into a swirling mix of Portland cement and water, in a mixing vessel, to achieve enhanced flowability and lowered water/cement ratio. Typically, the container or vessel has a wall adjacent which the slurry moves, and such vibration is transmitted to the slurry via the wall. In this regard, the of vibration transmission into the slurry which spirals downwardly to a discharge, can be adjusted to achieve or increase the enhancement effect. A metallic channel is typically attached to the outer vessel wall, and a vibrator is attached to the channel at a selected location along its length, to achieve such adjustment. Vibration is also typically transmitted to the downwardly swirling slurry at two different levels, and at opposite sides of the vessel, as will be seen.

A further object is to induce swirling of the slurry by operation of an impeller at the central downward discharge from the vessel, below the level of vibration transmission into the slurry. A stirring paddle may be provided and rotated in the vessel in conjunction with rotation of the impeller, to further mixing and flowability of the slurry at the point of discharge.

Yet another object is to transmit such vibration to the slurry at a frequency or frequencies of between 1,200 and 4,000 cycles per minute.

An additional object is to recirculate the vibrated slurry to an upper level in the vessel, the enhanced fluidity of the treated slurry preventing clogging in the recirculating line. Such recirculation aids in mixing of slurry in the vessel.

These and other objects and advantages of the invention, as well as the details of an illustrative embodiment, will be more fully understood from the following specifications and drawings, in which:

DRAWING DESCRIPTION

Figure 5:
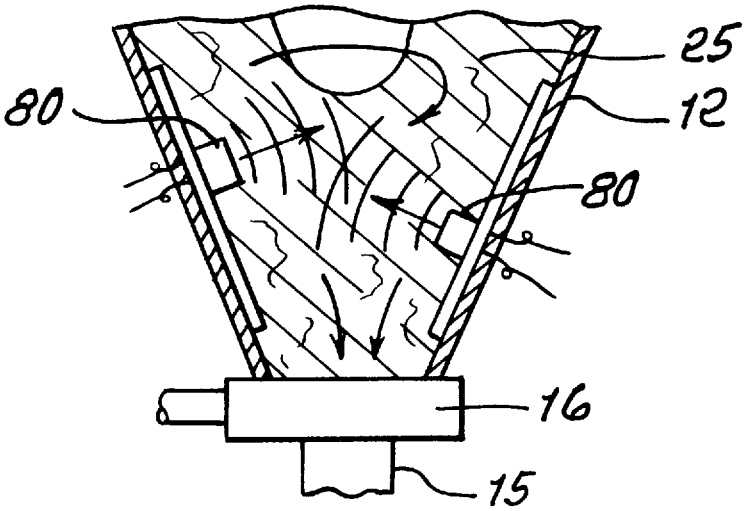
Figure 3:
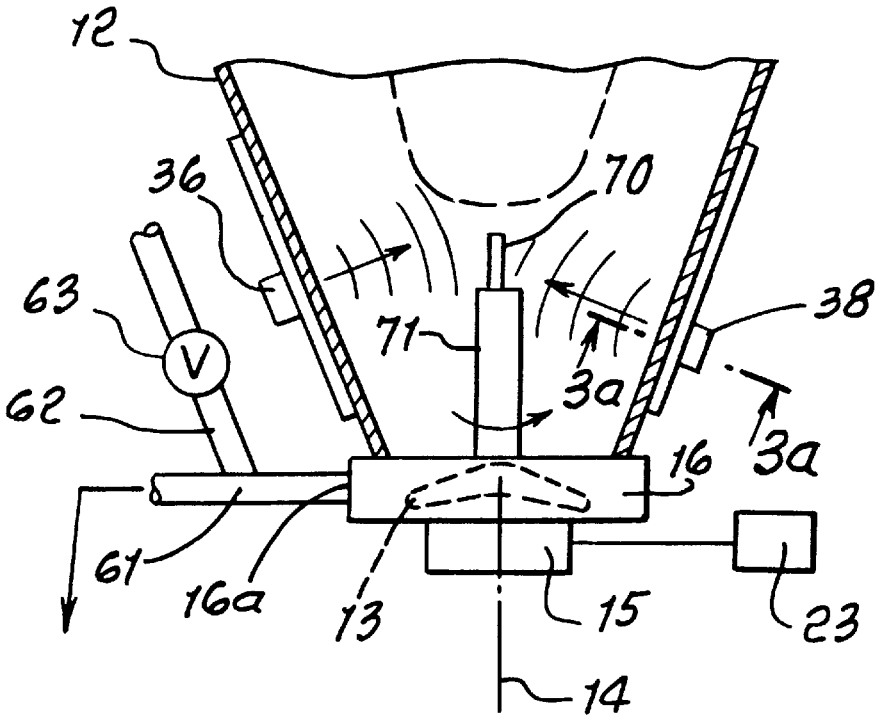
FIG. 3 is an enlarged fragmentary view showing a further modification.
Figure 3A:
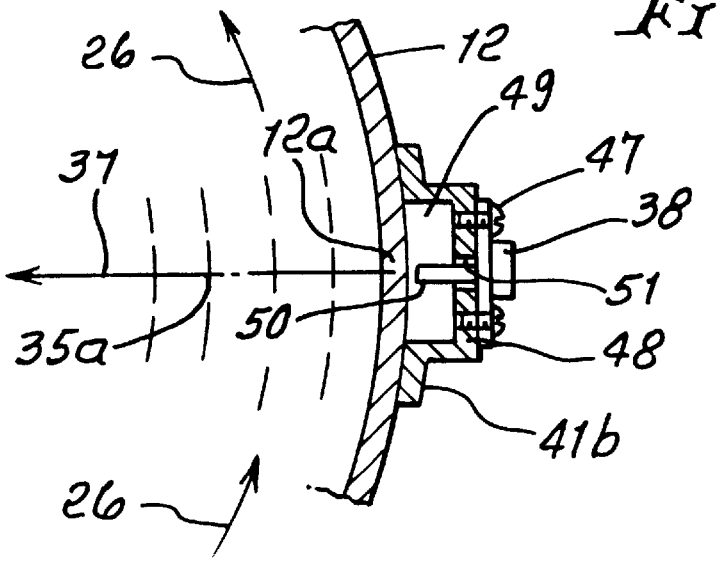
Figure 9:
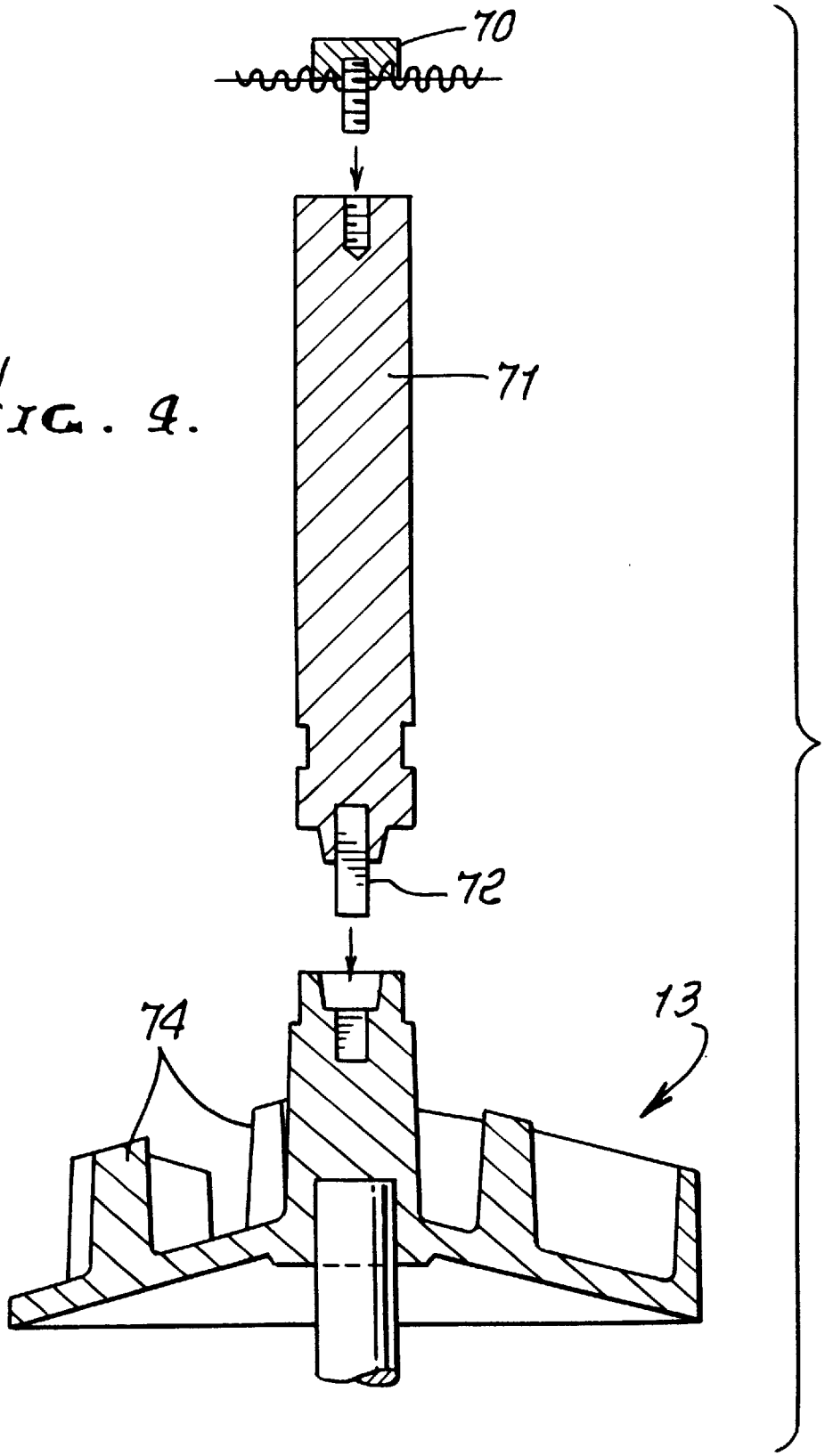

FIG. 3*a* is an enlarged section taken on lines 3*a*—3*a* of FIG. 3;

FIG. 4 is an enlarged view showing an impeller for driving a mixing paddle; and FIG. 5 is an enlarged fragmentary view showing yet another modification.

DETAILED DESCRIPTION

Figure 1:
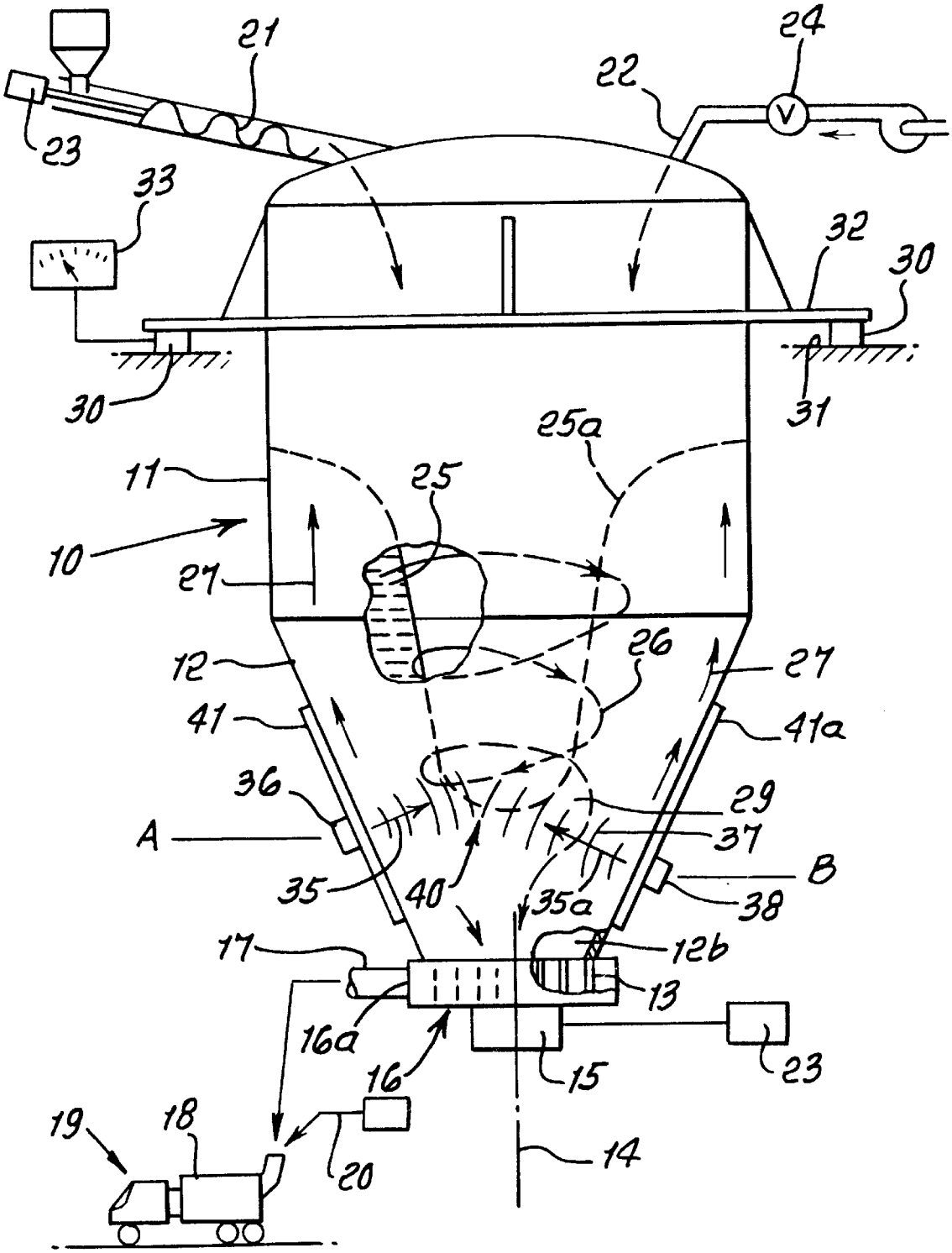
FIG. 1 is an elevation showing slurry mixing apparatus, with vibratory input.

Referring first to FIG. 1, a mixing vessel 10 has an upper cylindrical metallic wall section 11, and a lower conical wall section 12. Section 12 has a lower central discharge opening downwardly at 12*b* into an impeller 13 rotated about central vertical axis 14, as by a drive or motor 15. The latter is located beneath impeller housing 16. Slurry is discharged downwardly into the "eye" or center of the rotating impeller, the housing 16 having a side outlet at 16*a* for discharge of mixed cementitious slurry to a duct 17 leading to a rotating concrete mixer 18 on a truck 19. Wet sand and aggregate are also fed to the mixer 18, at 20.

Dry Portland cement is fed as at 21 to the vessel 10, and water is fed at 22. The cement screw 22 is controlled at 23, and the water delivery is controlled as by a valve 24, to deliver water and cement in the correct proportions to the upper interior of vessel 10, for mixing therein. Rotation of the impeller 13 is controlled by control 23 for the motor 15, to cause the impeller to induce rotation of the slurry 25 in the vessel, the slurry flow spiraling downwardly as indicated at 26, toward the outlet 12*b*, for flow into the impeller.

Some upward recirculation of slurry from lower region 29 can, or does, occur as indicated by arrows 27 adjacent the inner sides of the vessel walls.

A vortex is created by the rotating slurry, whereby the rotating slurry is centrifugally urged toward the vessel wall, creating a central "well" or open region, inwardly of broken line 25*a*, which has the shape of an inverted dome. Mechanism to weigh the vessel and its contents may include the transducers or load cells 30 supported at 31, and supporting a horizontal flange 32 attached to the vessel. See weight indicator 33, and by which the amount of cement and water in the vessel may be determined for batch volume control.

In accordance with the invention, vibration is transmitted into the moving slurry in vessel, as for example sidewardly into the spiraling mass of slurry 25. See the vibratory waves or pulsations transmitted at 35 into and in the slurry from at least one vibration source 36 at one level. Preferably vibrating waves or pulsations are also transmitted at 37 into the slurry from another vibration source 38 at a different (lower) level, and in a direction toward waves 35 to produce at least some interference effect, for increasing the effectiveness of the waves to enhance mixing of cement and water, including wetting of cement particles. The interference zone is indicated at 40. For this purpose, vibration source, i.e. vibrator 36 may be located at one side of the vessel lower interior; and vibration source or vibrator 38 located at the generally opposite side of the vessel, as shown. Also the relative levels of the vibrators may be adjusted, or "tuned" to optimize resultant enhancement of mixing for creation of enhanced fluidity of the mix, below the lowermost level of the inverted dome defined by broken line 25*a*, and above the discharge outlet.

In the example shown, the vibrator may be carried by channel structure 41, attached to the vessel conical wall as shown, to extend generally downwardly, and sidewardly. Two such channels 41 and 41*a* are shown.

FIG. 3*a* shows attachment of channel flanges 41*b* to the vessel wall 12. Vibrator 38 is removably attached as by fasteners 47 to the channel wall 48 spaced at 49 from the vessel wall. The vibrator may have a reciprocating armature 50 which extends to wall 12 to transmit vibration to local region 12*a* of wall 12, and resultant vibrating pulsations are transmitted as at 35*a*, cross-wise of the slurry flowing in a spiral path as indicated by arrows 26. The channel wall 48 has an opening 51 to pass the armature, and there may be a series of such openings spaced apart up and down the channel length, and on wall 48, whereby the vibrator may be selectively located at different of the openings 51 to raise or lower the level of vibration transmission into the swirling slurry, for enhancement of mixing and increase of slurry fluidity.

In this regard, one usable vibrator is MODEL SFC-100, a product of Vibco, Inc. Such a vibrator operates at about 4 amps at 115/230 volts. If desired, the vibrator may simply vibrate the channel, i.e. armature 50 can be omitted. Vibrator flanges 54 are attached by fasteners to the channel wall. Typical vibrator frequencies are between about 1,200 and 4,000 cycles per minute. The channel is sized to induce resonant or near resonant vibration transmission The objective is to improve Portland cement and water slurry mixing characteristics by lowering of the water/cement ratio from 0.40 to 0.45 at up to 100° F. water temperature, to 0.30 (or about 0.30) for water temperatures ranging from below 100° F. to 190° F.

Examples of comparative water/cement ratios for such water temperatures are as follows:

| W/C RATIO | BATCH WATER YDS.$^3$ GALLONS, LBS. | ALLOWABLE CEMENTITIOUS MATERIAL THRU VESSEL, LBS/YDS.$^3$ |
|---|---|---|
| .40 | 24–200 | 500 |
| .30 | 24–200 | 661 |
| .40 | 19–158 | 395 |
| .30 | 19–158 | 526 |
| .40 | 15–125 | 312 |
| .30 | 15–125 | 417 |

This represents a major improvement, in that more Portland cement, relative to water, can be mixed in the vessel, for flow to the concrete delivery truck.

Figure 2:
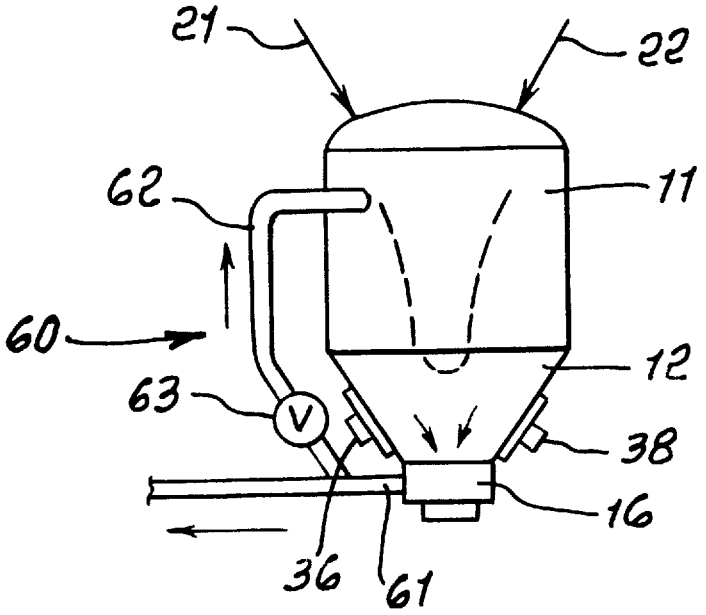
FIG. 2 is an elevation showing a modification.

FIG. 2 shows a mixed slurry recirculation at 60 from the impeller discharge zone 61 to the upper interior of the vessel, as via line 62 containing a flow control valve 63. The line 62 discharges tangentially to the direction of slurry swirl flow, to aid such swirl flow, for further enhanced mixing. See also U.S. Pat. No. B 1 4,830,505. Vibration enhanced fluidity of the mix assures that the flow in line 62 will not become clogged.

FIGS. 3 and 4 show the provision of a mixing paddle 70 carried by the rotating impeller or motor driven shaft to project upwardly, on a stem 71, into the lower interior of the vessel, above outlet 12*b*. Rotation of the paddle at impeller speed, i.e. at an RPM greater than the slurry swirl rotary cycle speed, causes enhanced mixing movement and helps to prevent slurry clogging at the point of discharge downwardly into the impeller. A key 72 couples stem 71 to the impeller hub. Note impeller vanes 74 projecting upwardly to induce mix swirling.

FIG. 5 shows vibrators 80 installed at the inside of the vessel lower interior to transmit vibration directly into the moving slurry.

I claim:

1. The method of treating an aqueous, cementitious slurry, the slurry consisting essentially of water and Portland cement, that includes:

a) providing a container for the slurry and effecting movement of the slurry, in the container, and b) transmitting sufficient vibration to the moving slurry to lower the water/cement ratio to about 0.30 for water temperature from below 100° F. up to 190° F., to enhance fluidity of the slurry.

2. The method of claim 1 wherein the container has a wall adjacent which the slurry moves, and said vibration is transmitted to the slurry via the wall.

3. The method of claim 2 including adjusting the location of said vibration transmission via the wall.

4. The method of claim 3 wherein said adjusting step includes shifting the location of said vibration transmission, along said wall.

5. The method of claim 1 wherein said movement of the slurry is effected in a swirling and downwardly flowing pattern, said vibration being transmitted to the swirling slurry.

6. The method of claim 5 wherein said vibration is transmitted to the swirling slurry at at least two vibration transmission locations at different levels relative to the slurry.

7. The method of claim 6 wherein said vibration transmitted at said two locations is generally oppositely directed into the swirling slurry.

8. The method of claim 7 wherein said vibration transmission is at a frequency or frequencies within the range 1,200 to 4,000 cycles per minute.

9. The method of claim 6 wherein sufficient vibration is transmitted into the slurry at said two locations to enhance the flowability of the swirling slurry.

10. The method of claim 5 including providing a rotating impeller in the container, and inducing said swirling via said rotating impeller toward and into which the slurry flows, downwardly.

11. The method of claim 10 wherein the impeller has a discharge, said container has an upper interior, and including the step of recirculating some of the vibration treated slurry from the impeller discharge to said upper interior of the container, to further slurry mixing in the container.

12. The method of claim 5 wherein said vibration is transmitted directly to the swirling slurry.

13. The method of claim 12 including locating vibrating means that produces said transmitted vibration within the container containing the swirling slurry.

14. The method of claim 5 including locating vibrating means producing said transmitted vibration within the container containing the swirling slurry.

15. The method of claim 1 wherein said vibration is transmitted at a frequency or frequencies within the range 1,200 to 4,000 cycles per minute.

16. The method of claim 1 wherein said vibration is transmitted directly into the moving slurry.

17. The method of treating an aqueous, cementitious slurry, to enhance fluidity, that includes:

a) providing a container for the slurry and effecting movement of the slurry, in the container, and b) transmitting vibration to the moving slurry, c) the container having a wall adjacent which the slurry moves, and said vibration is transmitted to the slurry via the wall, d) adjusting the location of said vibration transmission via said wall, said adjusting including shifting the location of said vibration transmission, along said wall, and e) and including providing a channel adjacent the wall at the side thereof opposite the slurry, and shifting the location of said vibration transmission along the channel.

18. The method of claim 17 wherein said channel is sized to produce resonance or near resonance vibration with respect to the channel and container.

19. The method of claim 17 including providing a vibrator means, operating said vibration means to produce said vibration, and adjustably attaching said vibrator means to the channel.

20. The method of treating an aqueous, cementitious slurry, to enhance fluidity, that includes:

a) providing a container for the slurry and effecting movement of the slurry, in the container, and b) transmitting vibration to the moving slurry, c) said movement of the slurry being effected in a swirling and downwardly flowing pattern, said vibration being transmitted to the swirling slurry, d) inducing said swirling via a rotating impeller toward and into which the slurry flows, downwardly, e) and including also stirring the slurry, in the swirl direction of rotation, at a location immediately above the impeller, and in the path of slurry flow toward the impeller.

21. The method of claim 20 including providing a stirring paddle at said location, and rotating said paddle in conjunction with rotation of the impeller.

22. The method of claim 21 wherein said paddle is caused to project upwardly at said paddle location, and below the level of said vibration transmission into the swirling slurry.

23. The method of claim 20 wherein sufficient vibration is transmitted to the moving slurry to enhance fluidity of the slurry.

24. In apparatus for treating an aqueous, cementitious slurry, the slurry consisting essentially of water and Portland cement, the combination that includes:

a) a container for the slurry and means effecting movement of the slurry, in the container, and b) vibrator means coupled with the container and operated at a frequency for transmitting sufficient vibration to the moving slurry to lower the water/cement ratio to about 0.30 for water temperature from below 100° F. up to 190° F. and to enhance fluidity of the slurry, c) the slurry consisting essentially of water and Portland cement, and sufficient vibration being transmitted into the moving slurry to lower the water/cement ratio to about 0.30 for water temperature from below 100° F. up to 190° F.

25. The apparatus of claim 24 wherein the container has a wall adjacent which the slurry moves, and said vibration is transmitted to the slurry via the wall.

26. The apparatus of claim 25 including means for adjusting the location of said vibration transmission via the wall.

27. The apparatus of claim 24 wherein said movement of the slurry is effected in a swirling and downwardly flowing pattern, said vibrator means producing said transmitted vibration which is transmitted to the swirling slurry and sidewardly thereof.

28. The apparatus of claim 27 wherein said vibrator means includes two vibrators to transmit vibration to the swirling slurry at at least two vibration transmission locations at different levels relative to the slurry.

29. The apparatus of claim 28 wherein said vibration transmitted at said two locations is generally oppositely directed into the swirling slurry.

30. The apparatus of claim 29 wherein said vibration transmission is at a frequency or frequencies within the range 1,200 to 4,000 cycles per minute.

31. The apparatus of claim 27 including a rotating impeller within the container and inducing said movement and swirling of the slurry.

32. The apparatus of claim 31 wherein the impeller has a discharge, said container has an upper interior, and including means for recirculating some of the vibration treated slurry from the impeller discharge to the upper interior of the container, to further slurry mixing in the container.

33. The apparatus of claim 24 wherein said vibration is transmitted at a frequency or frequencies within the range 1,200 to 4,000 cycles per minute.

34. In apparatus for treating an aqueous, cementitious slurry, to enhance fluidity, the combination that includes:

a) a container for the slurry and means effecting movement of the slurry, in the container, and b) vibrator means coupled to the container for transmitting vibration to the moving slurry, c) the container having a wall adjacent which the slurry moves, and said vibration is transmitted to the slurry via the wall, d) and including means for adjusting the location of vibration transmission via the wall, e) and wherein said means for adjusting vibration transmission includes a channel adjacent the wall at the side thereof opposite the slurry, said vibrator means attached to the channel to be shifted therealong.

35. The apparatus of claim 34 wherein said channel is sized to produce resonance or near resonance vibration with respect to the channel and container.

36. In apparatus for treating a aqueous, cementitious slurry, to enhance fluidity, the combination that includes:

a) a container for the slurry and means effecting movement of the slurry, in the container, and b) other means transmitting vibration to the moving slurry, c) said movement of the slurry being effected in a swirling and downwardly flowing pattern, said other means including vibrator means for producing said transmitted vibration and which is transmitted to the swirling slurry and sidewardly thereof, d) and including a rotating impeller within the container and inducing said swirling, e) and including also stirring means for locally and rapidly stirring the slurry, at a location immediately above the impeller, and in the path of slurry flow toward the impeller.

37. The apparatus of claim 36 wherein said stirring means includes a stirring paddle at said location, said paddle rotating in conjunction with rotation of the impeller, the paddle projecting upwardly at said paddle location, and below the level of said vibration transmission into the swirling slurry.

38. The apparatus of claim 36 wherein sufficient vibration is transmitted to the moving slurry by said vibrator means effecting said vibration transmission and operated at a frequency to enhance fluidity of the slurry.

39. The apparatus of claim 38 wherein said vibration is transmitted into the slurry at two locations, to enhance the flowability of the slurry.

40. The apparatus of claim 38 wherein the slurry consists essentially of water and Portland cement, and sufficient vibration is transmitted into the moving slurry to lower the water/cement ratio to about 0.30 for water temperature from below 100° F. up to 190° F.

* * * * *